United States Patent [19]

Vonnegut

[11] 4,436,485

[45] Mar. 13, 1984

[54] TURBINE WHEEL WITH INTEGRAL DS BLADES AND EQUIAXED HUB

[75] Inventor: George L. Vonnegut, Indianapolis, Ind.

[73] Assignee: General Motors Corporation, Detroit, Mich.

[21] Appl. No.: 174,034

[22] Filed: Jul. 31, 1980

Related U.S. Application Data

[62] Division of Ser. No. 896,709, Apr. 17, 1978, Pat. No. 4,240,495.

[51] Int. Cl.[3] ..... F01D 5/14

[52] U.S. Cl. ..... 416/241 R; 164/122.1

[58] Field of Search ..... 416/241 R, 244 A; 164/127, 122.1, 125; 148/39

[56] References Cited

U.S. PATENT DOCUMENTS

| | | | |
|---|---|---|---|
| 3,260,505 | 7/1966 | Ver Snyder | 416/241 X |
| 3,342,455 | 9/1967 | Fleck et al. | 416/241 |
| 3,376,915 | 4/1968 | Chandley | 164/127 X |
| 3,614,976 | 10/1971 | Bolling et al. | 164/122 |
| 4,063,939 | 12/1977 | Weaver et al. | 416/241 R X |
| 4,184,900 | 1/1980 | Erickson et al. | 416/241 R X |

*Primary Examiner*—Harvey C. Hornsby
*Assistant Examiner*—Christine A. Peterson
*Attorney, Agent, or Firm*—Elizabeth F. Harasek

[57] ABSTRACT

A cast metal turbine wheel is made comprising a cylindrical disc with equiaxed grains and integral blades with columnar grains oriented substantially parallel to the leading and trailing blade edges. The blades are solidified unidirectionally by withdrawing heat through chill means located adjacent the mold at the blade tips. Cooling is inhibited from other blade surfaces by retaining cast metal in mold portions located above and below the blades. The disc portion of the mold is insulated so that it cools slowly to promote grain nucleation throughout the metal therein and equiaxed grain growth.

2 Claims, 3 Drawing Figures

TURBINE WHEEL WITH INTEGRAL DS BLADES AND EQUIAXED HUB

This invention was made under Government Contract No. DAAJ02-77-C-0011.

This is a Division of U.S. Ser. No. 896,709 filed Apr. 17, 1978, now U.S. Pat. No. 4,240,495.

BACKGROUND OF THE INVENTION

This invention relates to cast metal turbine wheels with integral airfoil blades. More particularly, the invention relates to making turbine wheels with a radially oriented columnar grain structure in the blades and a substantially equiaxed grain structure in the disc.

Turbine wheels located immediately downstream from the combustion can of a turbine power plant must operate at high temperatures and under mechanical stress generally destructive to cast metal. It is generally known that any defect in an airfoil blade may lead to its failure. One way of reducing the probability of blade failure is to promote the growth of unidirectionally oriented columnar grains therein with grain boundaries substantially parallel to the leading and trailing edges. On an average, such blades are less susceptible to fatigue fracture and have longer service lives. The turbine wheel disc, on the other hand, should have an equiaxed grain structure to more evenly distribute hub forces at typical wheel speeds of 20,000 revolutions per minute or more. Before this invention it was not known how to integrally cast a turbine wheel with columnar grain blades and an equiaxed grain disc. In particular, the relatively large surface area and small volume of the airfoil blades promoted rapid cooling of the metal cast therein with the incumbent formation of equiaxed grains. Although unidirectionally solidified blades might be precast and then attached to an equiaxed disc by powder metallurgy or casting techniques, the finished wheel might be prone to failure under operational stress at the point of blade attachment.

OBJECTS OF THE INVENTION

It is therefore an object of the invention to provide a cast turbine wheel with integral disc and blades. The blades have columnar grains which are oriented substantially parallel to their leading and trailing edges, whereas the disc has substantially equiaxed grains. It is a further object of the invention to provide a method of making such a turbine wheel by casting metal into a suitable mold and then controlling cooling of the cast metal therein to produce the desired different grain structures in the disc and blades. It is a more particular object to provide a means of selectively unidirectionally solidifying metal cast in the blade portions of a mold. A chill means is provided at the blade tips and cast metal is retained in mold portions above and below the blades to retard cooling in any direction other than through the chill means. The mold portion adjacent the disc is insulated to promote equiaxed grain growth of the metal cast therein.

BRIEF SUMMARY OF THE INVENTION

In accordance with a preferred embodiment of my invention, these and other objects are accomplished by first providing a suitable thin-walled mold. The casting cavity therein comprises portions defining the cylindrical disc and the airfoils of a desired integral blade turbine wheel. The mold is also provided with two annular cavity portions which are located in closely spaced apart positions above and below the blade cavities. The radial dimension of the annular portions is coextensive with the length of the blades. They are adapted to contain enough cast metal to prevent cooling of the metal in the blade cavities from the blade faces. The annular portions are suitably gated to the hub cavity or other portions of the mold so that cast metal flows therein when the mold is filled.

In preparation for casting, the mold is preheated and placed in a vacuum pouring furnace. A suitable high strength metal, e.g., a nickel-chromium alloy, is cast into the mold. The mold is then removed from the furnace and allowed to cool at ambient temperatures.

A chill means is provided adjacent the mold at the blade tips to withdraw heat from the metal cast in the blade cavity portions in a radially outward direction. The means suitably comprises a mass of a thermally conductive material such as steel shot. While heat is withdrawn radially outward into the chill means, the metal retained in the above described annular cavities prevents substantial cooling from the blade faces. Thus, the blades are unidirectionally solidified radially inward promoting the growth of the desired columnar grains. The sides of the mold adjacent the disc cavity are insulated to prevent chill faces from developing. Thus, uniform grain nucleation and equiaxed grain growth are promoted throughout the disc. Because the blades and disc are integrally cast, the subject turbine wheels are particularly resistant to failure at the blade-disc joint area.

My invention will be more fully understood from a detailed description thereof which follows. Reference will be made to the drawings in which.

DETAILED DESCRIPTION OF THE INVENTION

Figure 1:
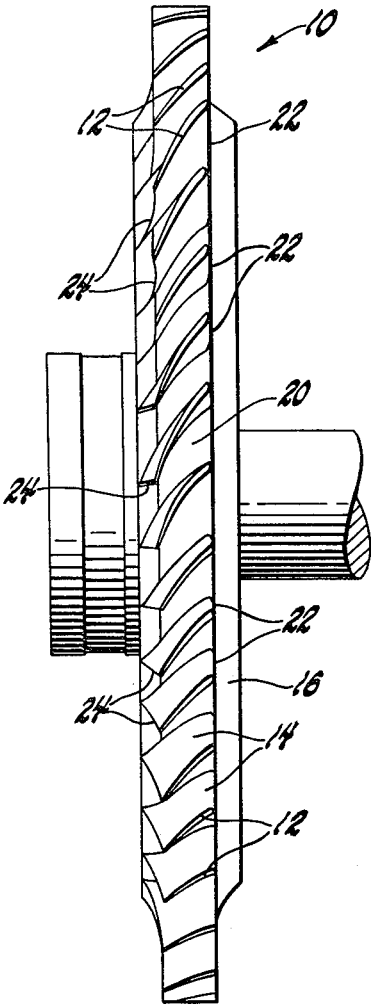
FIG. 1 shows a side view of a turbine wheel with integrally cast turbine blades and disc.
Figure 3:
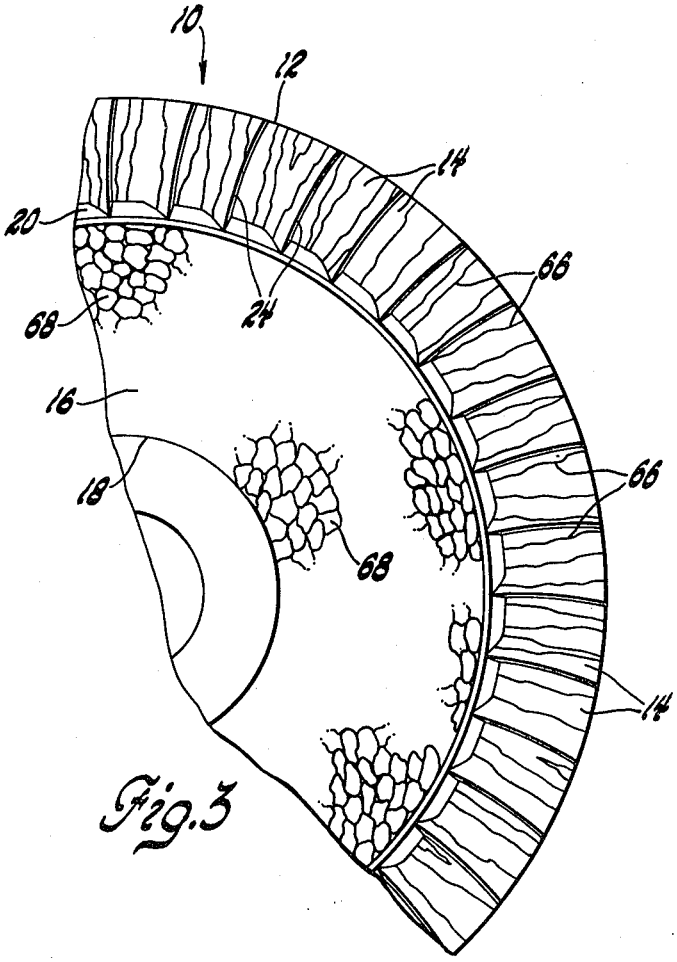
FIG. 3 is a fragmentary view of a wheel cast according to the invention showing columnar grain structure in the blades and equiaxed grain structure in the hub.

In accordance with a preferred embodiment of my invention a turbine wheel casting like that shown at FIGS. 1 and 3 was made. It is of the type used in the first rotor stage of a 400 horsepower, gas fired turboprop aircraft power plant. The wheel 10 has a diameter between blade tips 12 of about 7.6 inches with blades 14 about 0.9 inch long, and a disc 16 thickness of about 0.5 inch at the hub 18 opening machined into the disc center. Blades 14 are equally spaced around the perimeter 20 of disc 16 and angled with respect to the plane of disc 16 to provide the desired airfoil effect. As shown at FIG. 1, blades 14 are thicker at their leading edges 22 and taper slightly towards their trailing edges 24.

Figure 2:
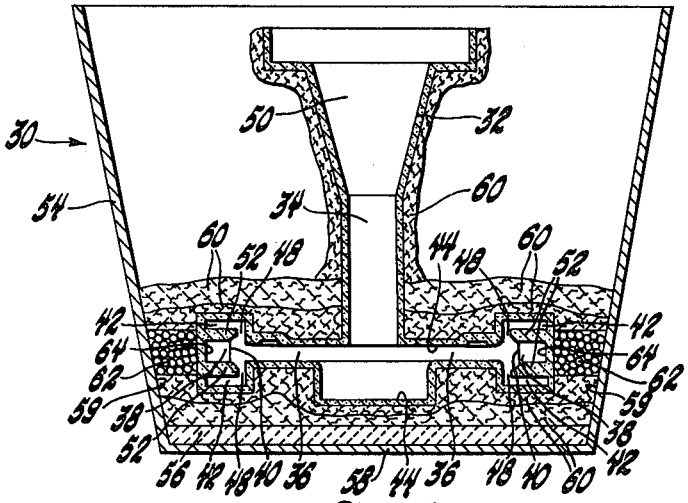
FIG. 2 represents a sectional view of apparatus for casting a turbine wheel according to the invention. A shell mold is shown positioned inside a suitable container with insulating and chill materials in place.

FIG. 2 shows an assembly 30 for casting a turbine wheel with integral blades in a shell mold 32. The casting cavity 34 of mold 32 comprised portions defining wheel disc 36 and attached blades 38 about the disc perimeter 40. Annular cavity portions 42 were provided above and below blade cavities 38, spaced apart from blade cavities 38 by about ¼ inch. Annular portions 42 were coextensive with the length of blades 38 and about ½ inch thick. They were provided to contain a mass of molten cast metal that is initially hotter than the surrounding mold. These high temperature masses placed close to blade cavities 38 markedly reduce the cooling of the metal in the blade cavities through face portions of the cavities. Obviously, the size of heater portions 42, and their distance from the blade cavities may be adjusted by one skilled in the art to provide the desired effect for a particular casting. I have also successfully cast a subject turbine wheel employing a single heater portion below the blades. An exothermic hot topping material may be packed in down sprue 50 to further retard rapid cooling of metal cast in wheel disc 36 and assist the formation of equiaxed grains therein. Gates 48 were provided between perimeter 40 of disc cavity 36 and annular cavities 42. Downsprue 50 was provided at the center of disc 36 to receive the cast metal poured from a crucible.

The refractory shell mold 32 was formed by a well known method around a wax pattern shaped to define casting cavity 34. The pattern was first dipped in a mixture of colloidal silica and zircon flour, and then stuccoed while still wet by dipping in a fluidized bed of zircon sand. The coating was allowed to thoroughly dry and the process once repeated. Four more layers were applied by dipping in a mixture of colloidal silica and silica flour and drying, thus creating shell mold 32 having a wall thickness of from about ¼ to ⅜ inch. The ¼ inch spaces 52 between wheel blade cavity portions 38 and annular cavity portions 42 were completely filled with the shell material, thus providing support to maintain this spacing when metal was cast. The mold was dewaxed in an autoclave at a steam pressure of about 80 psig.

A can 54 was provided for containing and supporting shell mold 32 during casting. Generally, any such container should be large enough to hold a shell mold and the insulating and chilling materials required by my method. It may be made of any suitable material which can withstand the temperatures encountered during casting. The can used herein was made from Hastelloy X® because of the alloy's excellent resistance to deformation at high temperatures and its ability to stand up to repeated thermal cycling.

A ceramic plate 56 about ½ inch thick was placed at the bottom 58 of can 54 to insulate and protect it. Two layers 60 of ½ inch thick Fiberfrax® padding sheet were then laid on top of ceramic plate 56. Fiberfrax® is an insulating ceramic fibrous material made from alumina and silica which maintains its insulating properties at casting temperatures. Other refractory insulating material, in padding, particle, or other form, could also be used so long as it would provide the required insulating effect.

Shell mold 32 was then placed in can 54 on top of insulating layers 60 so that downsprue 50 was oriented in an upright position for pouring, with the plane of disc cavity 36 substantially parallel to can bottom 58.

A quantity of chill material 62 in the form of steel shot was poured into can 54 to fill the space therein between shell mold 32, adjacent to blade tips 64, and containing wall 59 of can 54, a distance of about 1 inch. The steel shot provided a sufficient mass of thermally conductive material to withdraw heat from or "chill" tip ends 64 of blades 38. Generally, the mass of chill material 62 should be substantially greater than the mass of the cast metal in the blade cavity portions 38 to provide sufficient heat sink capacity. Ideally, a suitable chill material should directly contact the outside of the shell mold 32 adjacent the blade tips 64, so that heat can be most effectively withdrawn into it. Without such contact, it is more difficult to transfer heat through tips 64 to promote the desired columnar grain growth. The mass of the chill material may be adjusted, e.g., by increasing the diameter of can 54, to provide sufficient mass of the chill material at the blade tips 64. Other thermally conductive materials such as graphite, or high melting metals would be equally useful chill materials. Moreover, the chill material may be employed, e.g., as loose particles like the steel shot, or as preformed rings shaped to fit around the mold. Nickle shot is a preferred chill material because it is high melting, it is not oxidized or damaged by use, and it can be readily cleaned for reuse.

Two more layers 60 of the ½ inch Fiberfrax® padding were laid on top of the shell mold portion adjacent the top sides of disc cavity 36 and upper annular cavity portion 42. An additional insulating layer 60 was wrapped around downsprue 50.

The assembly 30 was then preheated to 1800° F., and placed in a vacuum furnace. A commercial heat resistance nickel based alloy, Mar M247® (nominal composition per 100 parts by weight: 0.15 carbon, 9.0 chromium, 0.5 molybdenum, 5.5 aluminum, 1.5 titanium, 10.0 cobalt, 10.0 tungsten, 1.35 hafnium, 0.05 zirconium, 0.015 boron, 3.1 tantalum and the balance nickel), was cast in mold 32 to fill casting cavity 34 at a temperature of about 2925° F. The vacuum seal on the furnace was broken and assembly 30 containing the liquid cast metal was removed and allowed to cool at room temperature.

The presence of the molten cast metal in annular portions 42 of cavity 34 served to prevent the metal in blade cavities 38 from rapidly cooling due to heat loss at the blade faces. However, steel shot 62 adjacent blade tips 64 withdrew heat from the cast metal therein radially outward, causing the metal to solidify solely in a radially inward direction with the formation and growth of columnar grains. Thus, as shown in FIG. 3, the blades 14 developed a columnar grain structure with the grain boundaries 66 aligned predominantly parallel to the leading and trailing blade edges.

I have found that the extreme tip of each blade cools so rapidly that an equiaxed grain structure develops. However, inward of this limited region, columnar grains form. Optimally, the mold is designed so that the blade cavities are slightly longer than the desired blades. Then the equiaxed tip portion can be removed from the casting so that the blades have completely unidirectionally oriented grains.

Insulation 60 above and below the disc cavity portion 36 prevented rapid chilling of molten metal cast therein at cavity surfaces 44. The insulation, in conjunction with the relatively large mass of the metal in the disc, is believed to encourage uniform grain nucleation throughout. Thus grain growth in the disc portion was isotropic and equiaxed grains like those shown at 68, FIG. 3, were formed. The directional columnar grains of the blades did not extend substantially into the disc portion of the turbine wheel. Thus, a turbine wheel was produced with the desired ideal grain structure of radial columnar grains in the blades in equiaxed grains in the hub.

Turbine wheels are usually made of the so-called "superalloys" which are resistant to oxidation, heat and mechanical stress during engine operation. Mar M247®, used in the example above, is one such superalloy, however, my method may also be used to cast turbine wheels from any other desired metal. Other well known superalloys useful for the invention may be based on nickel and chrome, cobalt, or iron and nickel (e.g., metals from the Hastelloy X®, Inconel®, and Udimet®, etc. families).

While my invention has been described in terms of a specific embodiment thereof, other forms may be adapted by those skilled in the art. Therefore, my invention is to be limited only by the following claims.

The embodiments of the invetion in which an exclusive property or privilege is claimed are defined as follows:

1. A cast metal turbine wheel comprising a cylindrical disc and integral turbine blades arrayed about the perimeter of said disc;

the grain structure of the metal of said blades being columnar, the grains being predominantly oriented lengthwise in the radial direction, substantially parallel to the leading and trailing edges of said blades;

the grain structure of the metal in said disc being predominantly equiaxed.

2. A turbine wheel formed of a cast nickel base alloy, suitable for use in the first stage of a turbine power plant, said wheel comprising a cylindrical disc and integral turbine blades arranged about the circumference of said disc;

the grains of said blades being predominantly oriented lengthwise in the radial direction with respect to said disc, substantially parallel to the leading and trailing edges of the blades; and the grains of said disc being predominantly equiaxed.

* * * * *